US009403168B2

(12) United States Patent
Pallmann

(10) Patent No.: US 9,403,168 B2
(45) Date of Patent: Aug. 2, 2016

(54) DEVICE FOR COMMINUTING FEEDSTOCK

(75) Inventor: Hartmut Pallmann, Zweibruecken (DE)

(73) Assignee: PALLMANN MASCHINENFABRIK GmbH & Co. KG, Zweibruecken (DE)

( * ) Notice: Subject to any disclaimer, the term of this patent is extended or adjusted under 35 U.S.C. 154(b) by 90 days.

(21) Appl. No.: 13/095,389

(22) Filed: Apr. 27, 2011

(65) Prior Publication Data

US 2011/0259986 A1 Oct. 27, 2011

(30) Foreign Application Priority Data

Apr. 27, 2010 (DE) ..... 20 2010 006 173 U

(51) Int. Cl.

| | |
|---|---|
| ***B02C 13/09*** | (2006.01) |
| ***B02C 13/282*** | (2006.01) |
| ***B02C 13/18*** | (2006.01) |
| *B02C 13/14* | (2006.01) |

(52) U.S. Cl.

CPC ..... *B02C 13/282* (2013.01); *B02C 13/09* (2013.01); *B02C 13/18* (2013.01); *B02C 2013/145* (2013.01)

(58) Field of Classification Search

CPC ..... B02C 2/10; B02C 19/22; B02C 13/09; B02C 13/18; B02C 13/282; B02C 18/007; B02C 2/007; B02C 13/28

USPC ..... 241/188.2, 261.1, 294, 295, 298, 260.1

See application file for complete search history.

(56) References Cited

U.S. PATENT DOCUMENTS

| | | | | | |
|---|---|---|---|---|---|
| 3,059,863 | A * | 10/1962 | Johnson | ..... | 241/294 |
| 3,452,939 | A * | 7/1969 | Johnson | ..... | 241/261.1 |
| RE29,053 | E * | 11/1976 | Cumpston, Jr. | ..... | 241/260 |
| 7,134,463 | B2 | 11/2006 | Pallmann | | |
| 2005/0167538 | A1 * | 8/2005 | Doelle et al. | ..... | 241/298 |
| 2008/0041995 | A1 * | 2/2008 | Hall et al. | ..... | 241/207 |
| 2010/0090044 | A1 * | 4/2010 | Pallmann | ..... | B02C 13/06 241/195 |

FOREIGN PATENT DOCUMENTS

| | | |
|---|---|---|
| DE | 202 16 056 U1 | 4/2004 |
| EP | 2 070 596 A1 | 6/2009 |

OTHER PUBLICATIONS

Machine English translation of EPO patent EP2070596A1 to Fischer, J., Jun. 2009.*

* cited by examiner

*Primary Examiner* — Alexander P Taousakis
*Assistant Examiner* — Chwen-Wei Su
(74) *Attorney, Agent, or Firm* — Muncy, Geissler, Olds & Lowe, P.C.

(57) ABSTRACT

A device for comminuting feedstock having a rotor, rotating within a housing around an axis, with rotor tools lying within the outer circumferential region on a circumferential ring and a stator, associated with the rotor, with stator tools arranged concentrically in the outer circumferential region and forming a comminuting surface, whereby the rotor tools and the stator tools lie opposite at a distance with the formation of a working gap and the stator tools are formed by segments, which to form the comminuting surface rest on the stator with their rear side and lie with their long sides against one another. The segments are attached to the stator in each case with their first short side and second short side by a positive fit, whereby the stator has a clamping element, which works together with the first short side and/or second short side to clamp the segments against the stator.

13 Claims, 5 Drawing Sheets

DEVICE FOR COMMINUTING FEEDSTOCK

This nonprovisional application claims priority under 35 U.S.C. §119(a) to German Patent Application No. DE 20 2010 006 173.3, which was filed in Germany on Apr. 27, 2010, and which is herein incorporated by reference.

BACKGROUND OF THE INVENTION

1. Field of the Invention

The invention relates to a device for comminuting feedstock.

2. Description of the Background Art

Devices of this type belong to the field of mechanical process engineering, particularly the conversion of a feed material into an end product of predefined shape and size by way of comminution. Such devices include, inter alia, disc mills, such as those disclosed, for example, by German Utility Pat. No. DE 202 16 056 U1, which corresponds to U.S. Pat. No. 7,134,463. Such disc mills have a rotor, which works together with a stator within a housing. The rotor includes a carrier disc, which is equipped along its outer circumferential area with grinding tools lying within the disc plane. The grinding tools lie opposite to stationary stator tools, arranged at the inner housing wall concentrically around the axis of rotation, at an axial distance with the maintenance of a grinding gap.

Both the rotor and stator tools can be formed by segments and are screwed onto the carrier disc or to the housing wall. This very time-intensive work increases not only the assembly costs during wear-related tool replacement, but also concurrently increases the length of downtimes of the disc mill, which conflicts with efficient utilization. For this reason, rotor and stator tools, which have a complete ring that can be replaced as a whole unit, are already in use in disc mills. This does in fact shorten the tool replacement times, but the profile of the grinding tools is limited in terms of manufacturing technology to a substantially radial fluting.

The conventional art also includes mills, such as those described, for example, in European Pat. Appl. No. EP 2 070 596 A1. The mill disclosed therein has a cone-shaped housing, whose inner circumference is provided with a grinding bed insert, shaped like a hollow truncated cone, to form a stator. Arranged coaxially within the grinding bed insert is a rotor, whose rotor tools are formed by radially oriented impact plates, which are suspended in a pendular manner and with maintenance of the grinding gap strike along the inner circumference of the stator tools. The grinding bed insert, shaped like a hollow truncated cone, forms the stator tools and is inserted as a whole unit into the housing, whereby a clamping ring at the larger-diameter front end of the housing assures the securing against axial positional changes of the grinding bed insert. As in the case of the previously mentioned one-piece tool rings in disc mills, based on the monolithic design of the grinding bed insert here as well only a substantially coaxial fluting on the inner circumference of the grinding bed insert is possible. Variations in the geometry of the fluting, to match the stator tool active surface for comminution to specific feedstock or to achieve a specific processing result, are not possible.

SUMMARY OF THE INVENTION

It is therefore an object of the invention to develop further conventional devices in regard to shortest possible downtimes during tool replacement and greatest possible flexibility in matching the stator tools to the feedstock and to the end product requirements.

Due to the invention, it is possible to satisfy simultaneously the thus far mutually exclusive requirements in the prior art for the most rapidly possible replacement of comminuting tools, on the one hand, and a greatest possible freedom during the selection of the type of fluting of the comminuting tools, on the other, within a device.

By means of the segment-like design of the stator tools it is possible for two successive segments to have a different fluting, as a result of which both the intensity of the comminution and the residence time of the feedstock within the comminution area can be controlled. At the same time, for assembly, the segments are merely placed in the stator and then fixed in their position with a clamping element. Extremely short downtimes caused by tool replacement can be achieved in this way. The invention therefore makes possible a more economic operation of the device of the invention by means of a simplified tool replacement with simultaneous qualitative improvement of the processing result due to the possibility of being able to better match the stator tools to the specific general conditions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
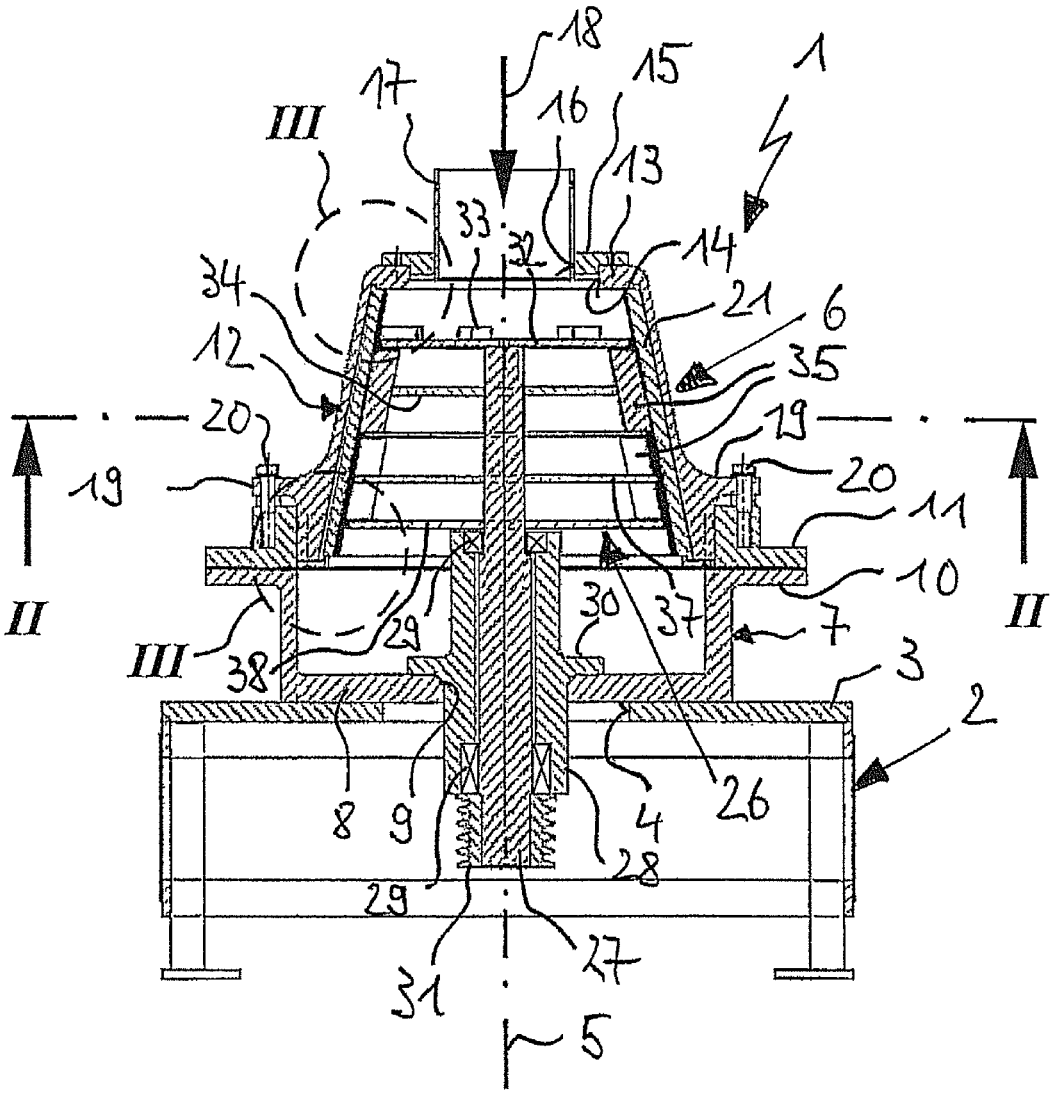
FIG. 1 shows a vertical section through a device of the invention along the line I-I depicted in FIG. 2.
Figure 2:
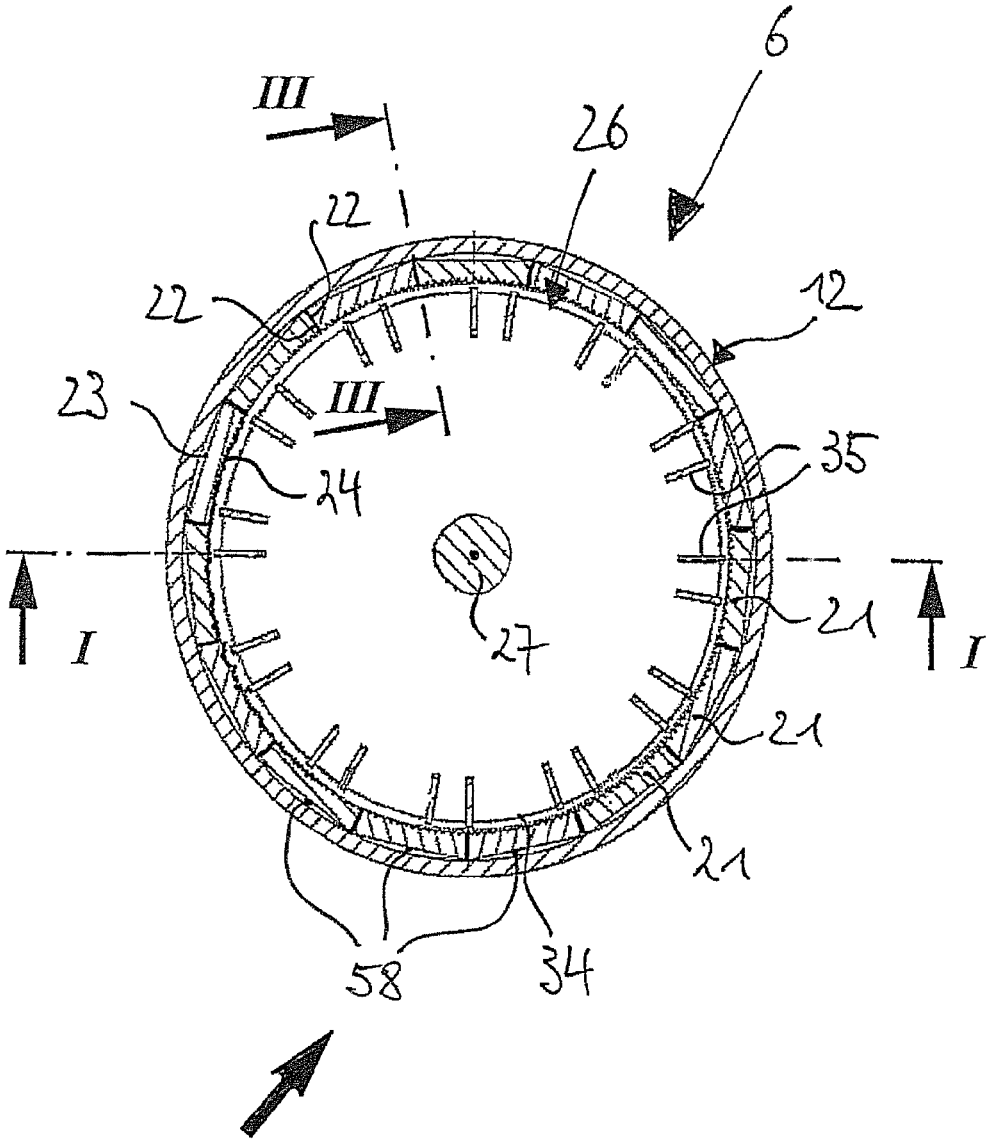
FIG. 2 shows a horizontal section through the device shown in FIG. 1 along the line II-II there.

FIGS. 1 and 2 depict a vertical and horizontal section through a device of the invention in the form of a mill 1. A frame-like base 2 can be seen, which is made of steel profiles and with its top side forms a horizontal platform 3 with central opening 4. Base 1 supports mill 1 of the invention, whose axis of rotation 5 is oriented perpendicular to platform 3 and extends through central opening 4.

Mill 1 comprises a housing 6 with a bottom part 7, which is formed by a cylindrical trough. Bottom 8 of the trough has a circular opening 9 concentric with the axis of rotation 5. Bottom part 7 is open upwards, the edge being formed by a circumferential annular flange 10. Annular flange 10 is used to support and attach a concentric bearing ring 11, which is formed angular in cross section and whose horizontal leg is connected to annular flange 10.

Housing 6 continues upward in a bell-shaped upper part 12, which is shaped like a hollow truncated cone and whose larger-diameter bottom side is open and associated with bottom part 7 and whose smaller-diameter top side has an opening 14, which is limited by a circumferential collar 13 radially facing inward. A removable cover 15 is bolted together removably with collar 13 and has a concentric feed opening 16, to which a feed connecting piece 17 is attached. Arrow 18 represents the feedstock which is fed axially into mill 1 through feed connecting piece 17.

The larger-diameter bottom side of upper part 12 has a circumferential annular flange 19 at the outer circumference, said flange which is supported via adjusting screws 20 on the vertical leg of bearing ring 11. In the housing section between annular flange 19 and the larger-diameter front end of upper part 12, the outer housing covering is formed cylindrically, in order to be guided with an accurate fit and axially movable within bearing ring 11. The distance between bottom part 7 and top part 12 can be adjusted by adjusting screws 20.

Upper housing part 12 with its inner circumference forms the stator, along which fifteen segments 21 forming the comminuting surface are arranged. The long sides 22 of segments 21 are formed for this purpose so that they run in each case within the axial planes relative to the axis of rotation 5. Segments 21 butt-jointed in the circumferential direction in this way form the stator tools of the rotor-stator system. To secure the relative position of segments 21 relative to one another, it is also possible to provide the mutually associated long sides 22 of two adjacent segments 21 with positive-fit elements, for example, in the form of a tongue and groove, which is not illustrated, however.

The cross section of segments 21 is evident primarily from FIG. 2. Accordingly, segments 21 have a planar rear side 23 and lie only with their longitudinal edges formed by rear side 23 and long sides 22 in each case linearly against the conically extending inner jacket of upper part 12, which results in a polygon-like course of the rear side of the comminuting surface. The linear mounting along the longitudinal edges, moreover, makes assembly easier compared with flat mounting, because manufacturing-related inaccuracies within the bearing surface would impede a snug seating of segments 21. Because the inner side of upper housing part 12 has a constant curvature, hollow spaces 58 which have a cross section in the form of circular segments and can be used, for example, for conveying a cooling medium, form between upper housing part 12 and the rear sides 23 of segments 21. The front side 24 of segments 21 has an arcuate curvature and is provided with fluting.

The size of the hollow spaces 58 resulting between segments 21 and the inner side of upper housing part 12 depends, inter alia, on the number of segments 21. The invention prefers a number of segments between 12 and 20, preferably between 15 and 18. A segment 21 therefore extends over $1/12$ to $1/20$, preferably over $1/15$ to $1/18$ of the inner circumference of the stator.

The particular formation of the two short sides 25 of segments 21 will be described in greater detail in regard to FIGS. 3 to 6.

A rotor 26 rotating around the axis of rotation 5 is evident within housing 6. Rotor 26 comprises a shaft 27, which is retained within a cylindrical shaft bearing 28 in bearing assembly 29 coaxially with the axis of rotation 5. In this regard, shaft bearing 28 is inserted over part of its length into opening 9 in bottom 8 of bottom part 7, whereby an annular flange 30 outwardly surrounding shaft bearing 28 is used for the positionally precise attachment of rotor 26 relative to housing 6. A multiple-groove pulley 31, which is coupled to a drive not shown in greater detail, is seated on the end of shaft 27 lying outside housing 6.

An impact plate 32 is attached on the face side to the opposite end of drive shaft 27 concentric with the axis of rotation 5. Hammering blocks 33, arranged in the circumferential area, at their top side facing feed opening 16 form a first comminuting stage for the feedstock entering mill 1 via feed connecting piece 17.

There is a first carrier disc 34 also seated concentrically on shaft 27 at an axial distance to impact plate 32; rotor tools are arranged in pairs in the form of impact plates 35 at the circumference of the carrier disc. In this case, the effective edges of impact plates 35 run parallel to the surface lines, forming the front side 24 of segments 21, with maintenance of a radial working gap. A first retarding disc 36 is arranged concentrically plane parallel and at an axial distance on drive shaft 27 in the direction of bottom part 7. The first retarding disc 36 is used to control the residence time and the material stream through mill 1 of the invention.

Another comminuting stage is formed by a second carrier disc 37 attached concentrically to shaft 27 and is equipped like the first carrier disc 34 with impact plates 35 at its circumference. Finally a second retarding disc 38, seated concentrically on shaft 27, follows in the flow direction through mill 1.

Figure 3:
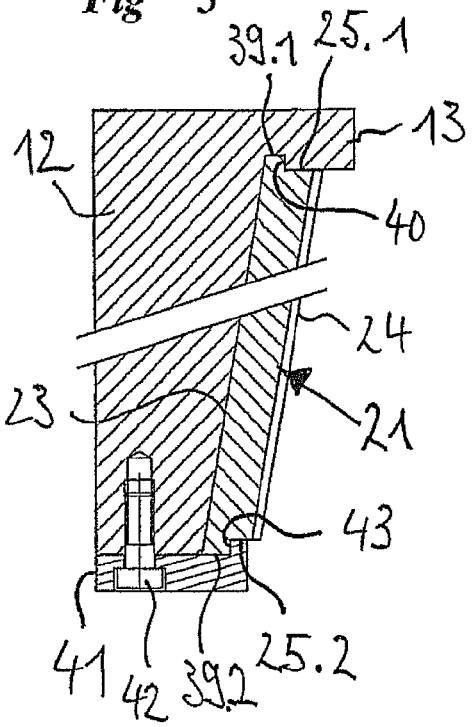
FIG. 3 shows a detail of the device shown in FIG. 1 in the areas designated by III.

Details of the attachment of segments 21 to upper part 12 of housing 6 emerge from FIG. 3. In this regard, FIG. 3 shows a section, as indicated with III-III in FIG. 2, and thereby is within the butt joint of two adjacent segments 21.

Each segment 21 for its attachment to upper part 12 along both short sides 25.1 and 25.2 in each case has an arcuate ledge section 39.1 and 39.2. In the installed state, ledge sections 39.1 and 39.2 of all segments 21 form a circular ledge, which runs concentrically around the axis of rotation 5.

For the positive-fit receiving of ledge section 39.1 at the first short side 25.1 an annular groove 40, likewise concentrically surrounding the axis of rotation 5, is arranged in upper housing part 12 on the inner side of collar 13. This enables the insertion of segments 21 with their ledge sections 39.1 into annular groove 40 in upper part 12 employed for assembly. In so doing, segments 21 reach the inner side of upper part 12 only with the longitudinal edges formed by long sides 22 and rear side 23.

To attach segments 21 in the area of the larger-diameter bottom side of upper part 12, a likewise concentric clamping ring 41 is provided, which can be clamped by means of screws 42 against the front end of upper part 12. Clamping ring 41 extends with its inner circumference radially inward via the opening to the bottom side of upper part 12 and has an annular shoulder 43 emerging axially from the ring plane, which during setting of clamping ring 41 on upper part 12 already equipped with segments 21 engages behind ledge section 39 at the second short side 25.2 of segments 21 and thereby assures their positionally precise position.

Figure 4:
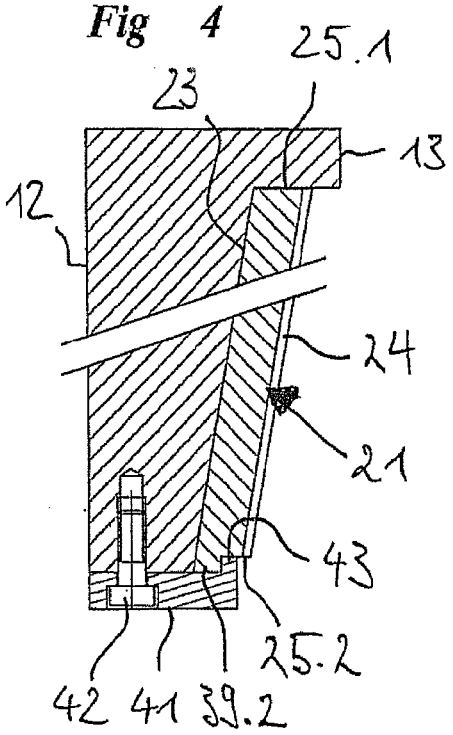
FIGS. 4 to 6 show alternative embodiments to the solution shown in FIG. 3.

In comparison with the embodiment shown in FIG. 3, the embodiment illustrated in FIG. 4 shows a simplified solution with respect to the manufacture of the device. In this case, the positive fit in the area of the first short side 25.1 is not produced by a tongue and groove construction. Instead, the first short side 25.1 and upper housing part 12 are formed in the common contact area and lie within a radial plane relative to the axis of rotation 5. In the area of clamping ring 41, the two embodiments according to FIGS. 3 and 4 are similar, so that the foregoing statements apply here as well.

Figure 5:
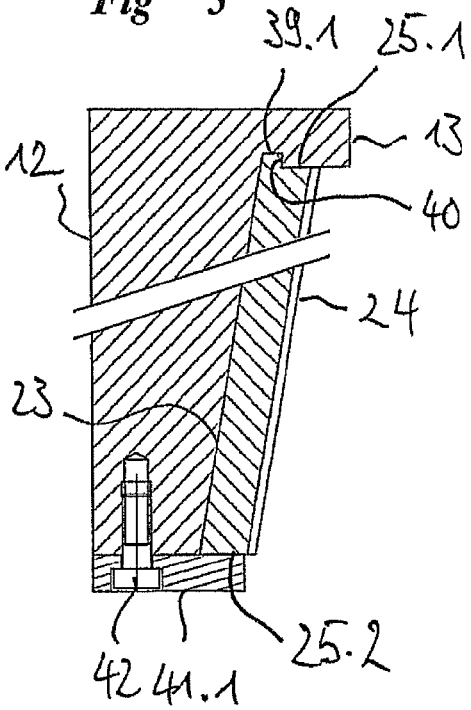

In the embodiment according to FIG. 5, the bracing of the first short side 25.1 in upper housing part 12 corresponds to that described in regard to FIG. 3. In contrast, the second short side 25.2 has a planar area within a radial plane, said area on which a clamping ring 41.1 with a correspondingly planar form acts.

Figure 6:
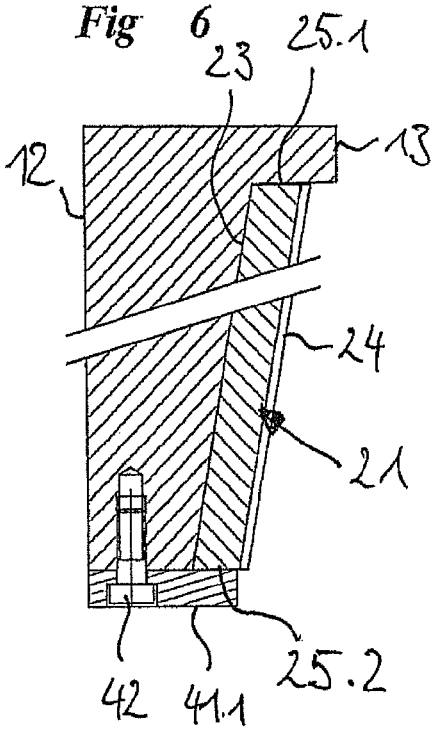

The embodiment according to FIG. 6 shows the greatest degree of simplification. Both the first top side 25.1 and second top side 25.2 of segments 21 are formed as planar here and are held in the axial direction by correspondingly planar bearing surfaces in upper housing part 12 or at clamping ring 41.1. The embodiment according to FIG. 6 shows to a certain extent a combination of the embodiments shown in FIGS. 4 and 5. A securing of the position of segments 21 in the radial direction results from the ring-shaped arrangement of segments 21 around the axis of rotation 5, whereby segments 21 are mutually braced via their long sides 22 and radially inward movements due to arching are prevented.

FIGS. 7 to 13 relate to embodiments of different arrangements of segments 21 at stationary or also rotating bearing elements, whereby the planes of attachment are each within a radial plane relative to the axis of rotation 5. Such solutions are suitable for implementing the invention in disc mills, for example, according to German Utility Pat. No. DE 202 16 056 U1 mentioned in the introduction to the description.

Figure 7:
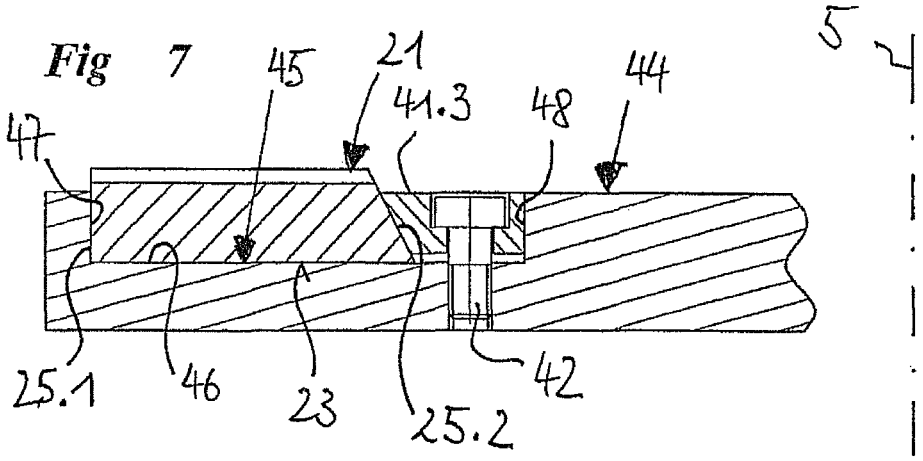
FIGS. 7 to 13 show corresponding detail solutions in conjunction with the devices of the invention in the form of disc mills.

In FIG. 7 a bearing element is designated with reference character 44, for example, a rigid or rotating bearing disc or a rigid housing wall. The comminuting tools, arranged in a circle around the axis of rotation 5, in the form of segments 21 are visible on the side of carrier element 44, said side facing the grinding gap. To attach segments 21, a recess 45 with a rectangular cross section, surrounding the axis of rotation 5 concentrically, is arranged in the surface of carrier element 44; the recess is formed by a bottom 46, an outer wall 47, and an inner wall 48.

Recess 45 is used for receiving segments 21, which with their rear side 23 rest with their entire surface against bottom 46 and with their first short side 25.1 with their entire surface against outer wall 47. The radial size of recess 45 is selected such that an annular space, which is used to receive a clamping ring 41.3, results between inner wall 48 and segments 21. In this regard, clamping ring 41.3 rests with its inner circumference against inner wall 48, whereas the outer circumference decreases in the direction toward the side facing bottom 46 to form a sloping circumferential surface. Clamping ring 41 acts via this sloping surface together with segments 21, whose second short side 25.2 widens linearly with the formation of a correspondingly inclined surface toward the rear side 23. In this way with the tightening of screws 42 a clamping force, acting radially outward against outer wall 47 and axially against bottom 46, is transmitted to segments 21 via the clamping ring 41.3.

Figure 8:
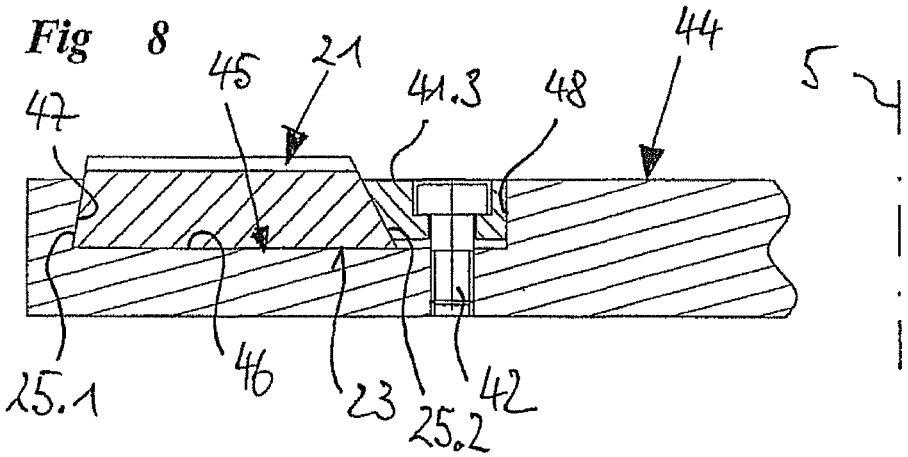

FIG. 8 differs from this embodiment only in that outer wall 47 is undercut toward bottom 46. The first short side 25, formed complementary thereto, of segment 21 engages behind the undercut wall 47 and is secured in this way in addition against axial lifting.

Figure 9:
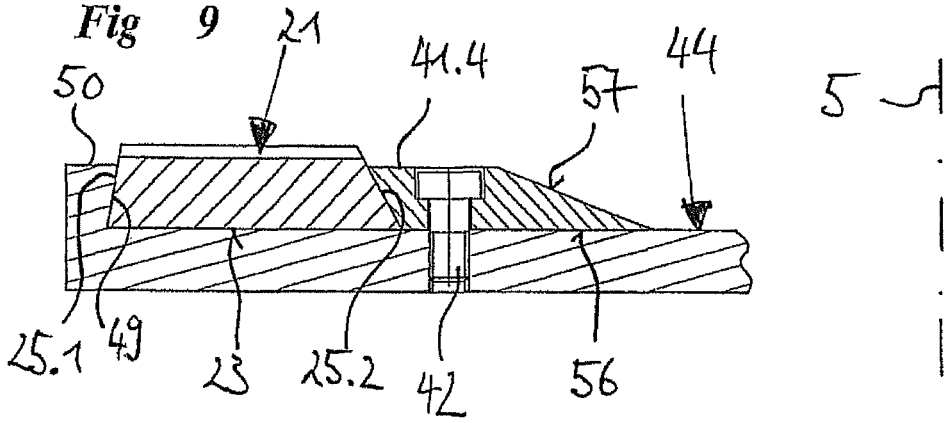

The embodiment of the invention as shown in FIG. 9 differs from the two previously described embodiments in that carrier element 44 has no channel-like recess 45, but a substantially planar surface, which has a circular wall 50, projecting from the plane, only at the outer circumferential area; the radially inwardly facing side 49 of said wall is undercut so that these areas correspond to the corresponding outer circumferential area of the embodiment shown in FIG. 8.

Clamping ring 41.4 has an outer circumference, corresponding to that described in FIG. 8, and therefore works together with the sloping second short side 25.2 as described in FIG. 8. In contrast, the inner circumference of clamping ring 41.4 is greatly widened in the direction toward carrier element 44 with the formation of an incline 57, to achieve as large a support area 56 as possible of clamping ring 41 at the planar top side of carrier element 44.

Figure 10:
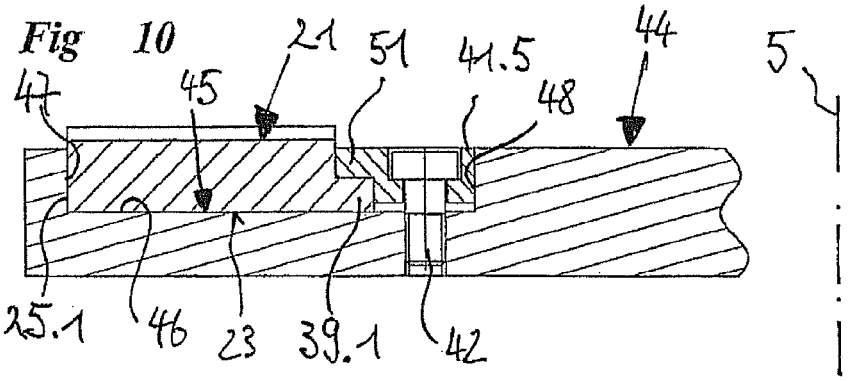

The embodiment according to FIG. 10 corresponds in many parts to that described for FIG. 7. There are differences in the area of the second short side 25.2 of segments 21, which widens in steps toward the rear side 23 of segments 21 with the formation of a rectangular ledge section 39.1. Clamping ring 41 has an outer circumference, formed complementary thereto, with an annular flange 51, which clamps ledge section 39.1 axially against bottom 46.

Figure 11:
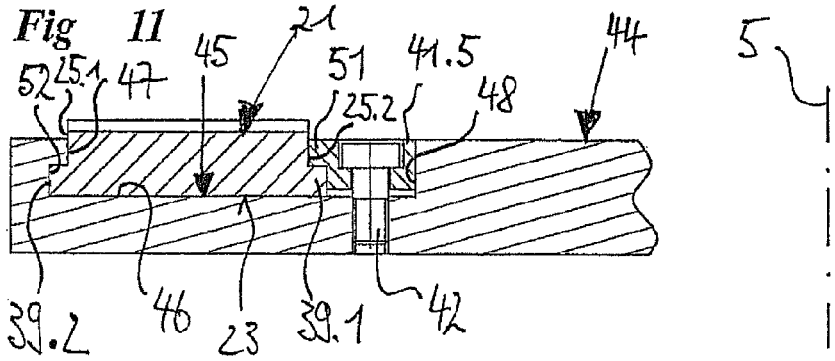

The embodiment according to FIG. 11 is similar to that described for FIG. 10 with the difference that segments 21 widen in steps also in the area of the first short side 25.1 toward rear side 23 and thereby form a ledge section 39.2, which engages with a positive fit in a corresponding groove 52 in outer wall 47. Segments 21 therefore have an axially symmetric cross section.

Figure 12:
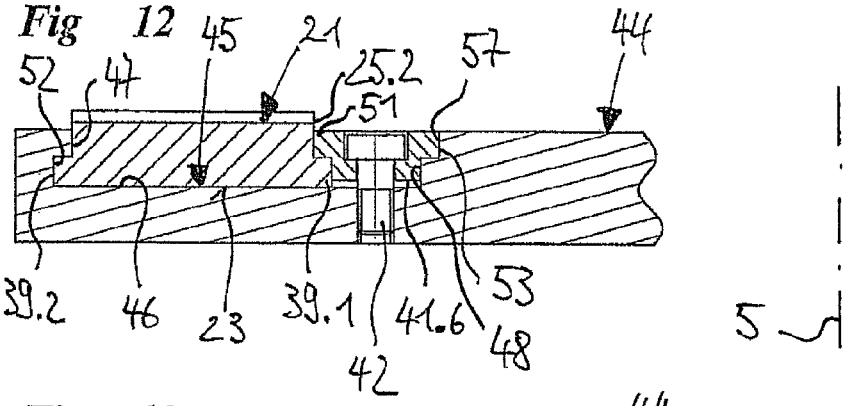

The embodiment of the invention shown in FIG. 12 differs from this in a clamping ring 41.6 axially symmetric in cross section. Clamping ring 41.6 has, as described in FIG. 11, a circumferential annular flange 51 at the outer circumference. In addition, there is a second annular flange 53, which is arranged in an analogous manner at the inner circumference of clamping ring 41.6. Inner wall 48 has a geometry complementary thereto with a ring-shaped recess 55, so that upon tightening of screws 42 clamping ring 41.6 rests both on ledge section 39.1 of second short side 25.2 and on recess 55 in inner wall 48 and is therefore stressed symmetrically.

Figure 13:
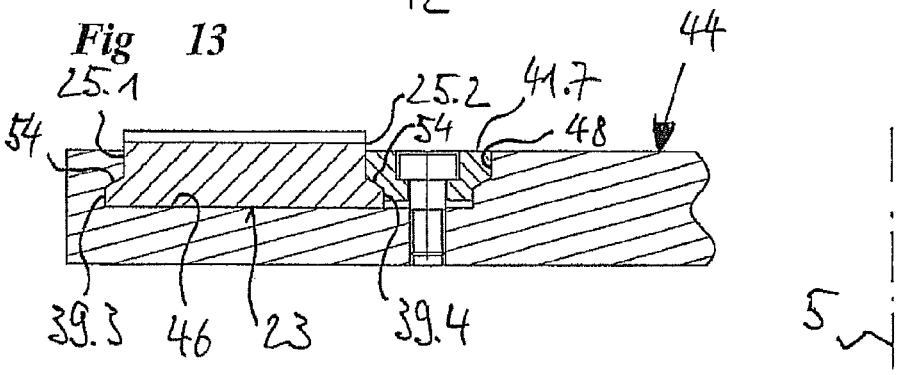

A variant of this is the subject of the embodiment disclosed in FIG. 13. Here, short sides 25.1 and 25.2, widening in the direction of rear side 23, each have ledge sections 39.3 and 39.4, with incline 54 sloping toward the outer circumference or the inner circumference in the direction of rear side 23. Upon clamping of the complementary formed clamping ring 41.7, in the contact area to segment 21, a radially outwardly directed component is generated in addition to the clamping force directed against bottom 46. An axially symmetric embodiment of clamping ring 41.7 in cross section and a complementary shape of wall 48 ensure a symmetric stress on clamping ring 41.7.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for comminuting feedstock, the device comprising:

a housing;

a rotor configured to rotate within the housing about an axis;

rotor tools arranged within an outer circumferential region on a circumferential ring; and a stator associated with the rotor, the stator having stator tools arranged concentrically in the outer circumferential region and forming a comminuting surface, wherein the rotor tools and the stator tools lie opposite to one another at a distance thereby forming a working gap, wherein the stator tools are formed by segments, which to form the comminuting surface rest on the stator with their rear side and lie with their long sides against one another, wherein the segments are attachable to the stator with their first short side and second short side by a positive fit, wherein the stator has a clamping element, which contacts the first short side to clamp the segments against the stator, wherein an extending direction of the first short side and the second short side is parallel to the first short side and the second short side, wherein the extending direction is perpendicular to an axial direction of the axis, wherein the stator includes a circumferential collar portion that protrudes from the stator, wherein the second short side of the segments directly contact the circumferential collar portion, wherein the clamping element is a clamping ring that is detachable from the stator and is concentric with the stator so as to clamp all of the segments, wherein the clamping ring directly contacts both the stator and the first short side of all of the segments, wherein the rotor and stator are formed cylindrical or conical, and wherein the segments have a flat, planar rear side and along the longitudinal edges, formed by the rear side and long sides, rest against the stator.

2. The device according to claim 1, wherein an edge between the first short side and the second short side at the rear side of the segment is wider than an edge between the first short side and the second short side at a front side of the segment.

3. The device according to claim 2, wherein at least one of the first short side or the second short side of the segment has a stepped formation to form a ledge section.

4. The device according to claim 1, wherein the first short side and the respective associated clamping element have complementary formed contact areas.

5. The device according to claim 1, wherein the clamping element is formed symmetric in cross section.

6. The device according to claim 1, wherein the first short side and the second short side of a segment are each formed of a flat, planar surface.

7. The device according to claim 1, further comprising at least one screw, wherein the clamping element is attached to the stator with the at least one screw.

8. The device according to claim 1, wherein the clamping element is provided with an annular shoulder that fits into a corresponding recess of the first short side of each segment.

9. The device according to claim 1, wherein the second short side of each segment is formed with a protruding ledge that fits into a corresponding groove of the circumferential collar portion of the stator.

10. The device according to claim 1, wherein the stator tools are clamped via the clamping element to the stator only in a direction towards the stator.

11. The device according to claim 1, wherein the entire second short side of the segments directly contact the circumferential collar portion, the entire second short side of the segments being parallel to the first short side of the segments that directly contact the clamping ring.

12. A device for comminuting feedstock, the device comprising:

a housing;

a rotor configured to rotate within the housing about an axis; and a stator associated with the rotor, the stator having segments arranged concentrically in an outer circumferential region thereof, wherein each segment has a front surface that forms a comminuting surface, a rear surface that at least partially abuts the stator, an upper surface, a lower surface and two side surfaces, the segments being arranged concentrically in the outer circumferential region such that a respective side surface of one segment opposes a respective side surface of an adjacent segment, wherein the plurality of segments are attachable to the stator via a clamping element, the clamping element contacting the lower surface of the segments so as to clamp the segments to the stator, wherein an extending direction of the upper surface and the lower surface is parallel to the upper surface and the lower surface, and the extending direction of the upper surface and the lower surface is perpendicular to an axial direction of the axis, wherein an extending direction of the two side surfaces is parallel to the two side surfaces, and the extending direction of the two sides surfaces is parallel to the axial direction of the axis, wherein the stator includes a circumferential collar portion that protrudes from the stator, wherein the upper surface of the segments directly contact the circumferential collar portion, wherein the clamping element is a clamping ring that is detachable from the stator and is concentric with the stator so as to clamp all of the segments, wherein the clamping ring directly contacts both the stator and the lower surface of all of the segments, wherein the rotor and stator are formed cylindrical or conical, and wherein the segments have a flat, planar rear side and along the longitudinal edges, formed by the rear side and long sides, rest against the stator.

13. The device according to claim 12, wherein the entire upper surface of the segments directly contact the circumferential collar portion, the entire upper surface of the segments being parallel to the lower surface of the segments that directly contact the clamping ring.

* * * * *